United States Patent [19]

Broadbent et al.

[11] Patent Number: 4,632,851

[45] Date of Patent: Dec. 30, 1986

[54] CONTINUOUS AUTODEPOSITION METHOD WITH BATH STABILIZATION

[75] Inventors: Ronald W. Broadbent, Ardsley; Ellsworth A. Stockbower, Lansdale, both of Pa.

[73] Assignee: Amchem Products, Inc., Ambler, Pa.

[21] Appl. No.: 725,470

[22] Filed: Apr. 22, 1985

[51] Int. Cl.[4] ..... B05D 1/18

[52] U.S. Cl. ..... 427/435

[58] Field of Search ..... 427/435

[56] References Cited

U.S. PATENT DOCUMENTS

| | | | |
|---|---|---|---|
| 3,791,431 | 2/1974 | Steinbrecher et al. | 427/435 |
| 3,839,097 | 10/1974 | Hall et al. | 427/435 |
| 3,936,546 | 2/1976 | Hall | 427/435 |
| 4,229,492 | 10/1980 | Leister et al. | 427/435 |

OTHER PUBLICATIONS

Hall, Journal of Coatings Technology, vol. 52, No. 663, pp. 72–78, Apr. 1980.

Johnson et al., Plating and Surface Finishing, Jul. 1984, pp. 58–62.

*Primary Examiner*—Richard Bueker

*Attorney, Agent, or Firm*—Ernest G. Szoke; Henry E. Millson, Jr.

[57] ABSTRACT

Continuous autodeposition from a bath having a low solids concentration and stable coating characteristics is achieved by close control of bath iron concentration, preferably by maintaining iron concentration below about 1.5 gm/l by controlled discard and replacement of bath volume.

18 Claims, 1 Drawing Figure

CONTINUOUS AUTODEPOSITION METHOD WITH BATH STABILIZATION

BACKGROUND OF THE INVENTION

1. Field of the Invention

This invention relates to stabilized autodeposition coating baths for coating metal surfaces. In particular, the invention relates to a continuous autodeposition coating process which is economical and provides uniform coatings of high quality throughout the life of the bath.

In order to obtain an autodeposition coating bath having optimum coating efficiency, bath components consumed in the coating process must be replenished, and contaminants generated must be removed.

In the coating of steel surfaces, iron is a major contaminant, with typical iron losses to the processing bath of 20–40 mg Fe/ft$^2$ (about 200–400 mg Fe/m$^2$) of surface treated. In large-scale commercial applications, such losses can translate into an iron build-up in the coating bath of 100 or more grams per hour, to concentrations in excess of 3 gm/1. At these concentrations, the bath interferes with the coating process, and the entire bath, including expensive resin components present, must be discarded in favor of a fresh bath. The gradual build-up of iron within the bath also has the disadvantage of progressively altering the coating characteristics of the bath, and coatings obtained from the spent bath before discard generally vary significantly in quality from coatings obtained from a fresh bath.

2. Prior Art

None of a variety of methods for maintaining autodeposition baths at optimum efficiency has been entirely successful when applied to continuous coating operations. In particular, the addition of phosphoric acid to autodeposition baths to precipitate iron for iron control has generated a troubling sludge in some systems, which is difficult to continuously and completely remove. In addition to depleting the bath of polymer coating material, the generating sludge tends to contaminate the product film coatings, and adversely affect their corrosion-protection abilities.

BRIEF DESCRIPTION OF THE DRAWING

The sole FIGURE is a graphic illustration relating bath concentration of iron to discard rate for autodeposition systems according to the invention.

DETAILED DESCRIPTION OF THE INVENTION

Figure 1:
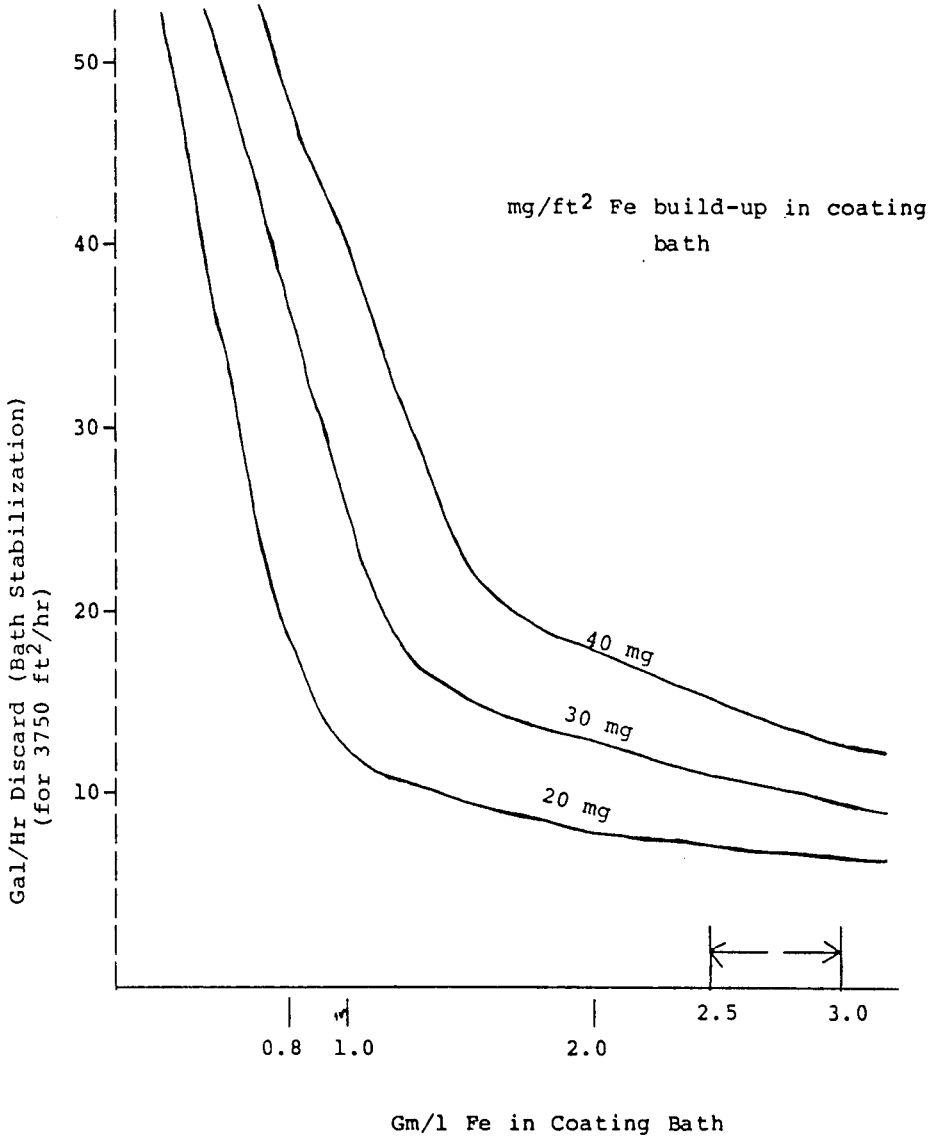

The invention provides a continuous autodeposition process employing an autodeposition bath composition having a low solids concentration of polymer latex. At solids concentrations of about 3% v/v or less, the process can be operated on a continuous basis with bulk or continuous adjustment of bath composition as needed to maintain active ingredients and contaminants at desired levels. The bath can, however, be saved and reused if desired, even after system shutdown for extraneous causes.

According to the invention, autodeposition baths having a solids concentration of about 4% v/v or less (usually comparable to about 7% w/w or less), e.g. from about 1 to about 4% v/v, are replenished by adding active ingredients to the bath in amounts sufficient to maintain the concentration of each ingredient substantially at its starting concentration in the fresh bath.

Replenishment of the bath may be accomplished continuously or in bulk, i.e., by continuous addition of small quantities of active ingredient, or by intermittent (including one-time) addition of relatively larger quantities of active ingredient. Preferably, the bath is replenished by addition of ingredients in concentrate form; in particular, replenishment of polymer solids is desirably accomplished by addition of the required amount of polymer solids in the form of a concentrate containing up to about 58% v/v solids, typically about 33–42% (w/w) or 28–35% (v/v).

Contaminant build-up in the bath, most particularly iron build-up, is controlled by intermittent or continuous removal of a predetermined volume of bath liquid, and replacement of this volume with water, in an amount sufficient to maintain iron concentration in the bath below harmful levels, i.e. levels at which the bath no longer coats satisfactorily.

Again, either bulk or continuous adjustment of bath volume is within the scope of the invention. The bath volume to be discarded is conveniently removed by continuously or intermittently overflowing the bath; alternately, a two-pump method can be used wherein flow or replacement water into the bath is controlled by one pump, and removal of bath liquid is controlled by another pump. Continuous operation of both pumps is usually preferred. The make-up liquid introduced will usually be deionized water, which may be combined with the necessary amount of replenisher concentrate prior to addition to the bath.

The replenishment rate, i.e., the rate at which an active ingredient is added to the bath, is dependent upon the rate at which the ingredient is consumed in the coating process, and the concentration of the ingredient in the replenishing material. In many systems, adjustment of the replenishment rate to maintain concentration of at least the polymer solids close to starting concentration in the fresh bath will be desirable; in other systems, significant depletion of the polymer solids prior to replenishment will be tolerable. Keeping active ingredients present in amounts of at least about 75% of starting concentration is generally recommended.

The discard rate, i.e., the rate at which used bath is discarded, is dependent upon iron loss to bath, which is in turn dependent upon the treatment rate of the substrate. The present invention is in part predicated on the discovery that in the low solids systems described herein, continuous autodeposition over extended time periods, up to several days or much longer, is achieved without bath difficulties if iron concentration in the bath is controlled by discarding portions of the bath to achieve an iron concentration below a critical point of the bath. Generally, bath iron concentration is maintained under about 3.0 gm/l, and preferably from about 0.5 to about 2.7 gm/l. It is very desirable that control of iron build-up begin well before the bath iron concentration reaches a deleterious level. While maintaining iron at lower concentrations mentioned may in some instances increase bath efficiency, resin losses in bath discard volumes will generally counterbalance any economic benefits deriving from the increased efficiency. Practical transfer efficiencies (T.E.) of the present process (resin losses to discard/resin in coating) of about 60% are obtainable for many systems, as compared to typical transfer efficiencies of less than about 50% for some prior art methods.

Suitable discard rates for maintaining iron concentrations at predetermined levels are readily calculated from the average iron accumulation rate (g Fe/hr) of the particular system employed. The volume of bath discarded should be sufficient to eliminate excess iron from the bath above the desired concentration. Alternatively, if the iron dissolution and line rates are known, the iron accumulation rate can be calculated, and the discard rate determined. Calculations are made according to the following equations, wherein line rate is defined as surface area of substrate treated per hour, iron dissolution rate is the total weight loss of iron to bath per surface area of substrate treated, and the iron accumulation rate is the average weight increase of iron in bath per hour:

$$\frac{\text{line rate } (m^2/hr) \times \text{Fe dissolution rate } (g^{Fe}/m^2)}{\text{desired iron concentration } (g/l)} = \text{discard} = \text{rate } (l/hr)$$

$$\frac{\text{iron accumulation rate } (g^{Fe}/hr)}{\text{desired iron concentration } (g/l)}$$

For standard commercial applications, line rates of about 300 to 500 $m^2$/hr and dissolution rates of from about 0.2–0.4 g Fe/$m^2$ are typical. At these rates, discard rates from about 60 to about 200 l, generally about 100 to about 125 l, of used bath per hour will usually be sufficient to maintain iron concentrations at least about 0.8 gm/l or slightly higher, to about 1.5 g/l. On a board average, about 5% v/v of the bath will be discarded for every five to ten hours of continuous utilization at customary commercial coating rates.

The discard rate defined disregards iron losses from carry-over of bath solution on substrates travelling to rinse. If these losses are figured in by known methods, a slightly lower discard rate will be possible, with concomitant savings of polymer precoat.

The figure graphically illustrates the relationship of varying Fe dissolution rates to bath iron concentration and discard rate. The graph is based on a line rate of 3750 $ft^2$/hr (348 $m^2$/hr) and dissolution rates expressed as iron build-up in coating bath, as these dissolution rates were calculated from the line rate and from data reflecting iron accumulation rate in the bath systems. At an increased line rate of 4500 $ft^2$/hr (418 $m^2$/hr), a 20% shift in the relationships occurs. The system employed was a vinylidene chloride copolymer resin system with iron fluoride activator of the type described in Example III, infra.

As is apparent from the Figure, reducing bath iron concentrations below about 0.8 g/l will be economically impractical for most applications; surprisingly, however, iron concentrations can be readily kept below potential harmful levels (indicated by arrows) with low volume discards. The process according to the present invention is accordingly feasible with the low-solids systems employed.

Suitable resins useful in the process of the invention broadly include polymers known to be useful in autodeposition processes, especially those derived from acrylic and methacrylic monomers in their free acid or esterified form, vinyl and vinylidene chloride, and (meth)acrylonitrile. Copolymers of monomeric vinylidene chloride with methacrylic or acrylic acid, butyl or methyl methacrylate, acrylonitrile, methacrylonitrile, acrylamide, and acrolein are particularly useful. Vinylidene chloride resin systems are especially contemplated, as is the polymerized product of ethylhexylacrylate, acrylonitrile, styrene, and methacrylic acid.

The autodeposition process of the invention is particularly applicable to the deposition of thin polymer films of about 0.50 to 1.0 mils on substrate surfaces; however, deposition of films of greater or lesser thickness, e.g., from about 0.25 to about 1.50 mils is also feasible.

The following examples are illustrative of the practice of the invention:

EXAMPLE I

TRANSFER EFFICIENCY OF RESIN (VINYLIDENE CHLORIDE COPOLYMER LATEX AUTODEPOSITION COATING CHEMICAL SYSTEM) WITH CONTROL OF IRON BY BATH DISCARD TECHNIQUE (LABORATORY)

Substrate steel panels were weighed* under the following process conditions (laboratory), and the iron dissolution rate to bath calculated as 30 mg/$ft^2$:

| | | |
|---|---|---|
| Time of panel in coating bath | 90 | seconds |
| Temperature of panel in coating bath | 20.5° | C. |
| Resin solids in coating bath | 5% | (b.w.) |
| Iron level in coating bath | 0.8 | g/L |
| Redox | 375 | mv. |
| 101 meter | 275 | micro-amps |
| Bath carry over to rinse | 102 | ml/$m^2$ |
| Film build (dry) on panel | 0.50 | mils (electrically measured) |

*Total weight loss from panels, less Fe in coating and on surface after removal of panels from coating baths.

From this data, a theoretical discard rate of a 1000 $ft^2$/hr line, using 2000 gal bath to maintain an iron concentration of about 0.8 g/l was calculated as follows:

A. Iron balance:

Input of Fe to bath:

Fe dissolution rate=30 mg/$ft^2$=30 mg/0.093 $m^2$=322 mg/$m^2$ (93 $m^2$/hr) (0.322 g/$m^2$)=29.946 g. Fe/hr dissolved from work surface and remaining in bath each hour.

B. Losses of Fe to bath:

1. (0.8 g/l) (0.102 l) (93 $m^2$)=7.588 g Fe/hr lost via carry-over of bath solution on surface
2. Calculated bath discard required:

$$\begin{array}{r} 29.946 \text{ g/hr} \\ -\ 7.588 \text{ g/hr} \\ \hline 22.358 \text{ g/hr} \end{array} \text{ to be removed by bath discard}$$

$$\frac{22.358 \text{ g/hr}}{0.8 \text{ g/l Fe}} = 27.9457 \text{ discard/hr}$$

C. Resin on Parts vs. Total Resin used:

1. Resin in coating (at 0.5 mils)=1984.5 gms (1.98 gm/$ft^2$×1000 $ft^2$)
2. Losses of Resin:

a. Carry-over:

(102 ml) (93 $m^2$)=9.486 l/hr $$(9.486 \text{ l/hr})\ (50 \text{ g/l}) = \frac{474.3 \text{ g resin lost}}{\text{(per hour)}}$$

b. Bath discard:

(From B-2, above)

(27.9475 l) (50 g/l)=1397.375 grams resin lost/hr c. Total losses to system: (a+b)

| | | |
|---|---|---|
| 474.3 g | carry-over losses | |
| + 1397.375 g | bath discard losses | |
| 1871.675 g | | |

D. Transfer Efficiency:

| | |
|---|---|
| Resin losses: | 1,871.675 g |
| Resin in coating: | 1,984.248 g |
| | 3,855.923 g |

1. Over-all transfer efficiency $$\frac{1,984.248}{3,855.923} = 51.46\% \ T.E.$$

2. Practical transfer efficiency (deletes carry-over, which is a fixed loss regardless of iron removal method)

3,855.923 less 474.3 (carry-over)=3.381.623

Then:

$$\frac{1984.248}{3381.623} = 58.68\% \ T.E.$$

EXAMPLE II

TRANSFER EFFICIENCY OF RESIN (VINYLIDENE CHLORIDE COPOLYMER LATEX AUTODEPOSITION COATING CHEMICAL SYSTEM) WITH CONTROL OF IRON BY BATH DISCARD (LARGE SCALE)

Substrate steel panels were treated under the following process conditions:

| BATH CONDITIONS: | |
|---|---|
| Resin solids: | 5% b.w. |
| Bath temperature: | 20.8° C. |
| Average Fe: | .825 g/l (.80 g/l–.85 g/l) |
| Redox: | 370–380 mv |
| 101 meter: | 270–285 micro amps |
| Film Density (dry): | 1.68 |
| Bath volume: | 9000 gal. |
| Average time of immersion: | 124 seconds |
| Average Film Build: | 0.55 (dry) |
| Work to bath (line rate:) | 4,062.5 $ft^2$/hr |

The bath was operated for 16 hours, treating 65,000 square feet of surface area. Without bath discard, Fe in bath climbed from 0.80 g/l to 0.85 g/l (=0.05 g/l). The bath discard rate to maintain a bath iron concentration of about 0.8 g/l was calculated as follows:

A. Iron build-up in bath:

(0.05 g/L) (9000 gal) (3.785 L/gal)=1703.25 g. Fe increase/16 hr

Calculating average Fe loss per sq. ft. of surface coated (iron remaining in processing bath only).

$$\frac{106.453 \text{ g/hr Fe}}{4062.5 \text{ sq. ft/hr}} = 26.2 \text{ mg/ft}^2 \text{ Fe}$$

B. Discard of bath required for Fe stability:

(if begun when Fe is at 0.8 g/l Fe) ΔFe=106.458 g Fe/hr $$\frac{106.453 \text{ g Fe/hr}}{0.8 \text{ g/l Fe}} = 133.066 \text{ liters/hr}(=35.156 \text{ gal/hr})$$

C. Resin balance:

1. Discard required:

Discarding 133,066 liters/hr of the 5 b.w. (resin) coating bath, produces following losses: (133,066 l/hr) (50 g/l)=6,650 g resin/hr loss.

2. Weight of coating on work (dry) at production rate of 4,062.5 sq ft/hr:

Dry coating: (4.0625) (93 units) (13.97 g/$m^2$) (1.68)=8867.1 g/hr

D. Transfer efficiency (T.E.)

1. Practical transfer efficiency: (omits carry-over solution on parts to rinse stage)

| | |
|---|---|
| (C-2) Weight of resin on parts: | 8,867.1 g/hr |
| (C-1) Weight of resin discarded: | 6,650. g/hr |
| Total weight of resin used (less resin lost via carry-over) | 15,517.1 g/hr |

$$\text{Practical } T.E. = \frac{8,867.1}{15,517.1} = 57.1\%$$

2. Theoretical over-all T.E.

Based on prior test data, average solution loss through carry-over was determined to be 3.0 gal per 1000 $ft^2$ of surface (includes racks and parts).

a. losses via carry-over:

(3.785 l/gal) (3.0 gal/1000 $ft^2$) (4.0625)=46.13 l/hr of bath

Resin loss is then: (46.13 l/hr) (50 g/l)=2,306.48 g resin b. Total resin loss to coating process: 15,517.1+2,306.48=17,823.584

$$\text{c. Over-all } T.E. = \frac{8,867.1}{17.823.584} = 49.75\%$$

EXAMPLE III

3"×4" steel Q-panels were treated in a 1 liter autodeposition bath.

| A. MATERIALS | | |
|---|---|---|
| | Material | Quantity |
| Replenisher: | D.I. $H_2O$ | 16.6 grams |
| | Carbon pigment | 7.3 grams |
| | Vinylidene chloride copolymer latex | 226.1 grams |
| Bath: | Above Replenisher | 100 grams |
| | D.I $H_2O$ to | 969 ml |
| | Starter | 31 ml |
| Bath Parameters (Initial) | Redox | 407 mV |
| | 101 | 220 uA |
| | % T.S. | 5.46 w |
| | Conductivity | 2700 uMhos |
| | Film Build (90 sec) | 0.4–0.5 |
| Replenishment to bath: | Redox - 15% $H_2O_2$ | as required to maintain redox at 350–400 mV (usually 2 drops/panel) |
| | 101 - Activator | 0.25 ml/$ft^2$ |
| | % T.S. - Replenisher | 3.2 ml/$ft^2$ |

The specific materials exemplified are characterized as follows:

Carbon pigment: a stabilized carbon black aqueous dispersion

Vinylidene chloride copolymer latex: a polyvinylidene chloride copolymer internally stabilized with a bound anionic surfactant—a commercial product of Union Carbide Co. sold as SARAN 143 are now sold as RAP 184.

Starter: an activator system of hydrofluoric acid, a water-soluble salt of $Fe^{+++}$, and water.

Activator: a dilute (typically about 20%) solution of hydrofluoric acid.

B. Using the above material for bath and replenishment, the bath was turned over and rinse-off examined after each 10 $ft^2$. Consumption data was collected and the bath was adjusted (stabilized) for iron values after each 10 $ft^2$. results are given as follows:

| $ft^2$ | 0 | 10 | 20 | 30 | 40 | 50 |
|---|---|---|---|---|---|---|
| Turnovers (25.7 $ft^2$/1 = 1 T.O) | 0 | 0.39 | 0.78 | 1.17 | 1.56 | 1.95 |
| Date | 7/20 | 7/22 | 7/23 | 7/27 | 7/29 | 8/20 |
| Bath Parameters Before Adj. | | | | | | |
| Redox | 407 | 407 | 403 | 406 | 406 | 420 |
| 101 | 220 | 300 | 300 | 310 | 335 | 325 |
| % T.S. | 5.4 | 5.33 | 4.67 | 5.34 | 5.19 | 5.14 |
| Fe | 1.10 | 1.32 | 1.27 | 1.24 | 1.31 | 1.20 |
| Conductivity | 2700 | 4000 | 3700 | 4100 | 4400 | 4300 |
| Film Build | 0.4–0.55 | 0.4–0.5 | 0.35–0.45 | 0.4–0.5 | 0.35–0.45 | 0.4–0.5 |
| Amount Discarded (ml) | — | 230 | 215 | 194 | 225 | 167 |
| Replenisher Added (grams) | — | 23 | 27 | 14 | 25 | 17 |
| Bath Parameters After Adj. | | | | | | |
| Redox | — | 390 | 395 | 420 | 402 | 435 |
| 101 | — | 205 | 235 | 230 | 210 | 250 |
| % T.S. | — | 4.93 | 4.98 | 4.82 | 4.81 | 5.03 |
| Fe | — | 1.02 | 0.95 | 0.96 | 0.87 | 1.00 |
| Conductivity | — | 3200 | 3400 | 3400 | 3400 | 3200 |

Rinse-off: Rinse resistance (QCTM 096) was examined after each 10 $ft^2$ of metal processed (before bath adjustment). All results were excellent including cut, wet film rinse resistance.

Comsumption: 1031 ml of bath/1.95 T.O. (turnover). Approximately half the bath (½ l) was discarded for each turnover in order to maintain iron level at 1 g/l.

EXAMPLE IV

In this example a 16,000 gal (60,560 liters) autodeposition bath was employed.

The bath comprised an aqueous dispersion of a copolymer of methacrylic acid, ethylhexylacrylate, acrylonitrile, and styrene with a surfactant (Dowfax 2Al-for surfactant, see Example VI), a coalescent (2,2,4-trimethylpentanediol-1,3-monoisobutyrate), deionized water, and pigment of the type employed in Example III. The average amount of surface area treated was 100,000 $ft^2$ (9,290 $m^2$) per day. The bath parameters were continuously maintained at the following values:

| | |
|---|---|
| % Total solids (b.w.) | 5.5–6.5 |
| Redox (mV) | 350–400 |
| 101 (uA) | 200–250 |

The amount of iron in the bath was controlled by bath stabilization according to the present invention. This value was maintained at 2.3 to 2.5 gms/l by discarding an average of 450 gal (1,703 liters)/day. The last volume of bath was then replaced with deionized water and bath replenishers to maintain the above mentioned bath parameters.

The replenisher composition was as follows:

| Material | Wt % |
|---|---|
| Copolymer | 85.81 |
| Surfactant | 0.08 |
| Coalescent | 6.41 |
| DI water | 5.33 |
| Pigment | 2.37 |

The replenisher had a specific gravity of 1.029±0.005; resin solids in the replenisher composition were adjusted to 36.9% b.w.±0.5%. This technique also maintains the bath conductivity at values of 4000–4200 uS. Higher conductivity values can be due to ionic contaminants (e.g. sodium and potassium ions) which can have deterimental effects on the deposition and the rinse-ability of the deposited coatings.

The average total amount of paint concentrate replenisher consumed in coating 1000 $ft^2$ (92.9 $m^2$) is 2 gal. (7.6 liters) The contribution of the amount required for bath stabilization of 0.64 (2.4 liters) per 1000 $ft^2$ of metal surface treated. The consumption of paint concentrate replenisher with bath stabilization is then estimated to be 147% of the estimated consumption without bath stabilization.

EXAMPLE V

The procedure of Example III was followed, except the following bath and replenisher were substituted for those of Example III (bath and replenisher ingredients are as characterized in Example III):

| | Material | Quantity |
|---|---|---|
| Replenisher: | DI $H_2O$ | 37.18 wt % |
| | Carbon pigment | 2.61 wt % |
| | Vinylidene chloride latex[a] | 60.21 wt % |
| Bath Make-up: | Replenisher | 147.9 gm (127.5 ml) |
| | DI $H_2O$ | 845.5–822.5 gm |
| | Starter (0.8–1.5 gm Fe/1) | 25.5–47.3 gm (27–50 ml) |

[a]RAP 184 - a product of Dow Chemical Co. (previously known as SARAN 143)

Results were comparable to those obtained in Example III.

EXAMPLE VI

The procedure of Example III was followed, except the following bath and replenisher were substituted for those of Example III (bath and replenisher ingredients were as characterized in Example III).

| | Material | Quantity |
|---|---|---|
| Replenisher | D.I. water | 23.12 wt % |
| | Carbon pigment (Ex III) | 3.15 wt % |
| | Dowfax 2A1* | 0.29 wt % |
| | Vinylidene chloride latex (RAP 184) Sp. gr. = 1.201 @ 60° F. % T.S. = 41.3% | 73.44 wt % |
| Bath: | Replenisher | 121.1 gm (100.8 ml) |
| | DI water | 872.2–849.2 gm |
| | Starter (0.8–1.5 g Fe/l) | 25.5–47.3 gm (27–50 ml) |

*a commercial anionic surfactant (alkylated diphenyloxide disulfonate) available from Dow Chemical Corp., Midland, MI.

Results were comparable to those obtained in Example III.

What is claimed is:

1. A method for the continuous autodeposition of a polymer onto a steel substrate to provide a uniform continuous coating thereupon, comprising (a) immersing the substrate in an autodeposition coating bath having a concentration of polymer solids below about 4% v/v;

(b) replenishing the active ingredients of the bath as they are consumed by addition of said ingredients to the bath at a replenishment rate sufficient to maintain the concentrations thereof substantially at their original levels; and (c) stabilizing the bath by continuously or intermittently discarding a predetermined volume of the bath and replacing said volume with an equal volume of water at a discard rate which maintains a substantially constant concentration of iron in said bath wherein said predetermined volume being discarded is in addition to that volume of the bath which is removed by dragout due to coated substrate removal from the bath.

2. The method of claim 1, wherein the predetermined volume of bath is intermittently discarded.

3. The method of claim 1, wherein the predetermined volume of bath is continuously discarded.

4. The method of claim 1, wherein the concentration of iron in said bath does not exceed about 2.5 gm/l.

5. The method of claim 1, wherein the concentration of iron in said bath is maintained at about 0.5 to about 1.5 gm/l.

6. The method of claim 1, wherein the iron dissolution rate from the steel substrate is from about 200 to about 400 mg iron per sq. meter of substrate surface treated.

7. The method of claim 1, wherein the bath discard rate is from about 60 to about 200 l/hr.

8. The method of claim 1, wherein the polymer is a vinylidene chloride copolymer.

9. The method of claim 1, wherein the polymer solids are replenished by addition of a concentrate containing up to about 50% v/v polymer solids.

10. The method of claim 9, wherein the concentrate is diluted with sufficient volume of deionized water to replaced the discarded volume of bath, and the diluted concentrate is added to the bath to replenish polymer solids and replace discarded bath.

11. The method of claim 1, wherein the replacement water is deionized water.

12. The method of claim 1, wherein said coating comprises a dry film having a thickness of from about 0.25 mils to about 1.00 mils.

13. The method of claim 12, wherein the film has a thickness of about 0.5 mils.

14. The method of claim 9, wherein the polymer solids are a vinylidene chloride copolymer latex, and are replenished by addition of a concentrate containing about 28 to 35% v/v polymer solids.

15. The method of claim 1, wherein the polymer is a copolymer of methacrylic acid, ethylhexylacrylate, acrylonitrile, and styrene.

16. The method of claim 6 wherein the bath discard rate is about 60 to 200 l/hr and the concentration of iron in said bath is maintained at about 0.5 to about 1.5 gm/l.

17. A method for the continuous autodeposition of a polymer onto a steel substrate to provide a uniform continuous coating thereupon, comprising (a) immersing the substrate in an autodeposition coating bath in which bath the iron dissolution rate for the steel substrate is from about 200 to about 400 mg iron per square meter of substrate surface treated, said coating bath having a polymer solids concentration of about 1 to 4% v/v;

(b) replenishing the active ingredients of the bath as they are consumed by the addition of said ingredients to the bath at a replenishment rate sufficient to maintain the concentrations thereof substantially at their original levels; and (c) stabilizing the bath by continuously or intermittently discarding a predetermined volume of about 60 to about 200 l/hr of the bath and replacing said volume with an equal volume of water at a rate which maintains a substantially constant concentration of iron in said bath, said substantially constant concentration being at a value which is less than about 2.5 gm/l wherein said predetermined volume being discarded is in addition to that volume of the bath which is removed by dragout due to coated substrate removal from the bath.

18. The method of claim 17 wherein the polymer coating comprises a dry film having a thickness of from about 0.25 mls to about 1.5 mls and the concentration of iron in said coating is maintained at about 0.5 to about 1.5 gm/l.

* * * * *